United States Patent [19]

Chen

[11] Patent Number: 4,812,956

[45] Date of Patent: Mar. 14, 1989

[54] FLEXIBLE LAMP-STRING DEVICE

[75] Inventor: Scott Chen, Taipei, Taiwan

[73] Assignee: Tien Teng Wang, Hsin Chuang, Taiwan

[21] Appl. No.: 97,722

[22] Filed: Sep. 17, 1987

Related U.S. Application Data

[63] Continuation-in-part of Ser. No. 23,933, Mar. 5, 1987, abandoned, which is a continuation of Ser. No. 826,999, Feb. 7, 1986, abandoned.

[51] Int. Cl.[4] ..... F21V 21/14

[52] U.S. Cl. ..... 362/249; 362/236

[58] Field of Search ..... 362/249, 227, 230, 235, 362/236, 189, 191

[56] References Cited

U.S. PATENT DOCUMENTS

| | | |
|---|---|---|
| 3,755,663 | 8/1973 | George, Jr. . |
| 4,107,767 | 8/1978 | Anquetin . |
| 4,143,411 | 3/1979 | Roberts . |
| 4,263,640 | 4/1981 | Altman . |
| 4,264,845 | 4/1981 | Bednarz . |

*Primary Examiner*—Henry A. Bennet

*Attorney, Agent, or Firm*—Staas & Halsey

[57] ABSTRACT

A lightly device including a mounting band, on which are bored one or more separate semi-circular grooves, lamp-string sets corresponding to the number of grooves and a plastic cover. The mounting band is made of flexible material so that the respective lamp-string device is shapeable into different patterns, words or the like and the lamp-string device is conveniently cut as required. Further, a flash controlling unit is connected to the lamp-string device to control the flashing of the lamp-string.

8 Claims, 3 Drawing Sheets

FLEXIBLE LAMP-STRING DEVICE

CROSS REFERENCES TO RELATED APPLICATIONS

This application is a continuation in part of U.S. application Ser. No. 023,933 filed Mar. 5, 1987 now abandoned, which is a continuation of U.S. application Ser. No. 826,999 filed Feb. 7, 1986 now abandoned.

BACKGROUND OF INVENTION

This invention relates to a flexible lamp-string device which can be bent into various forms, patterns, words, or the like or which can be cut as desired for decorations, especially for Christmas decorations, or other display purposes.

In general, a lamp-string is formed of a plurality of bulbs which are connected in series and many lamp-strings can be connected in series if a longer overall length of lamp-strings is required. Since the lamp-strings are connected in series, the number of lamp-strings which can be connected together is limited, because the electrical wires are designed to withstand a constant load. Further, conventional lamp-strings only light up in one color which at most provides a flashing function. Additionally, conventional lamp-strings cannot be cut to form different patterns, words, or the like since they are connected in series.

Therefore, this invention discloses flexible lamp-strings which are covered with a PVC tube and which are connected in parallel so that the flexible lamp-strings can be cut and shaped to different patterns, words or the like.

SUMMARY OF THE INVENTION

The primary objective of this invention is to provide a flexible lamp-string which is connected in parallel so that the lamp-strings can be cut or shaped as desired for decorative or display purposes.

Another objective of this invention is to provide a flexible lamp-string device which is water-proof and shock-proof by covering a solid PVC tube thereon.

The invention attains these objects by providing a lamp-string with flexible mounting band including grooves. The grooves include lamp-string sets that are connected in parallel. The mounting band is held in a waterproof tube.

Further objectives and advantages of the present invention will become apparent as the following description proceeds, and the features of novelty which characterize the invention be pointed out with particularity in the claims annexed hereto and forming a part of this invention.

DETAILED DESCRIPTION OF THE INVENTION

Figure 1:
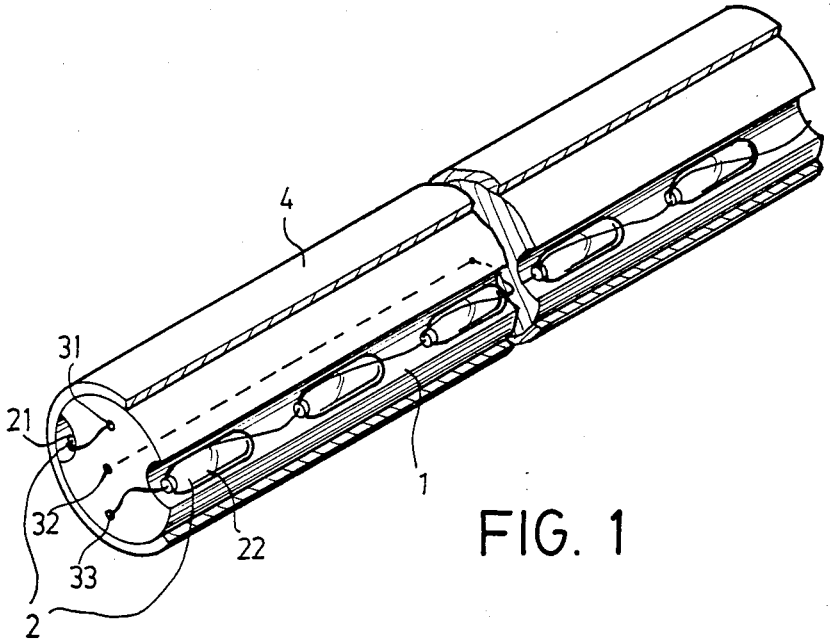
FIG. 1 is a partially cut-away view of the present invention.

Referring to FIG. 1, an embodiment of the invention can be seen. The lamp-string device of this invention comprises a pliable transparent mounting band 1, one or more lamp-string sets 2 of bulbs (the embodiment comprises two lamp-string sets), an appropriate amount of conducting wires (as 31, 32 and 33 in FIG. 1) and a PVC tube 4. The mounting band 1 is made of flexible materials so that it can be shaped into different patterns, words or the like for decorative or display purposes. The transparent soft mounting band 1 is axially bored with one or more separate semi-circular grooves 11 for installing the lamp-strings 2 therein. The lamp-string sets 2 may be variously colored for special effects. The conducting wires 31, 32 and 33 are also axially molded in the mounting band 1 which connects to the lamp-string to provide the lamp-strings current conduction. A circuit diagram for the device is shown in FIG. 2.

Figure 2:
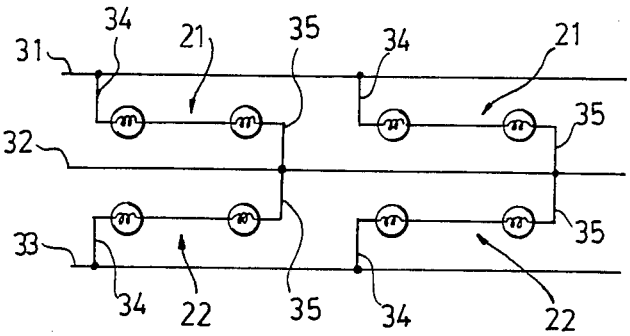
FIG. 2 is a circuit diagram showing the electrical connection of the present invention.

Now referring to FIG. 2, it can be seen that conducting wire 32 acts as a first channel and conducting wire 33 acts as a second channel. A lamp-string device is composed of a plurality of lamp-string sets. Each lamp-string set is formed of a constant number of lamp-strings. As FIGS. 1 and 2 show, the lamp-string 21 of a lamp-string set 2 has one end connected to the conducting wire 31 via line 34 and the other end connected to a common wire 32 via line 35. A lamp-string set 2 can be composed of a plurality of lamp-strings 21 or 22 connected to each other as mentioned hereinbefore. Therefore, such lamp-strings can be connected together for forming a longer lamp-string device and a long lamp-string device also can be divided as the situation might require.

Inside each of the bulbs which form a part of the lamp-string sets 2, there is a fuse (not shown) connected to two ends of the filament of the bulb for protecting the whole circuit. Further, for preventing the bulbs from breaking and for waterproofing, the mounting band 1 is covered by a transparent PVC tube 4. Because of the flexibility of the material of the mounting band 1 and the conduction design of the lamp-string, the invention can be shaped or cut for various purposes as required.

Figure 3:
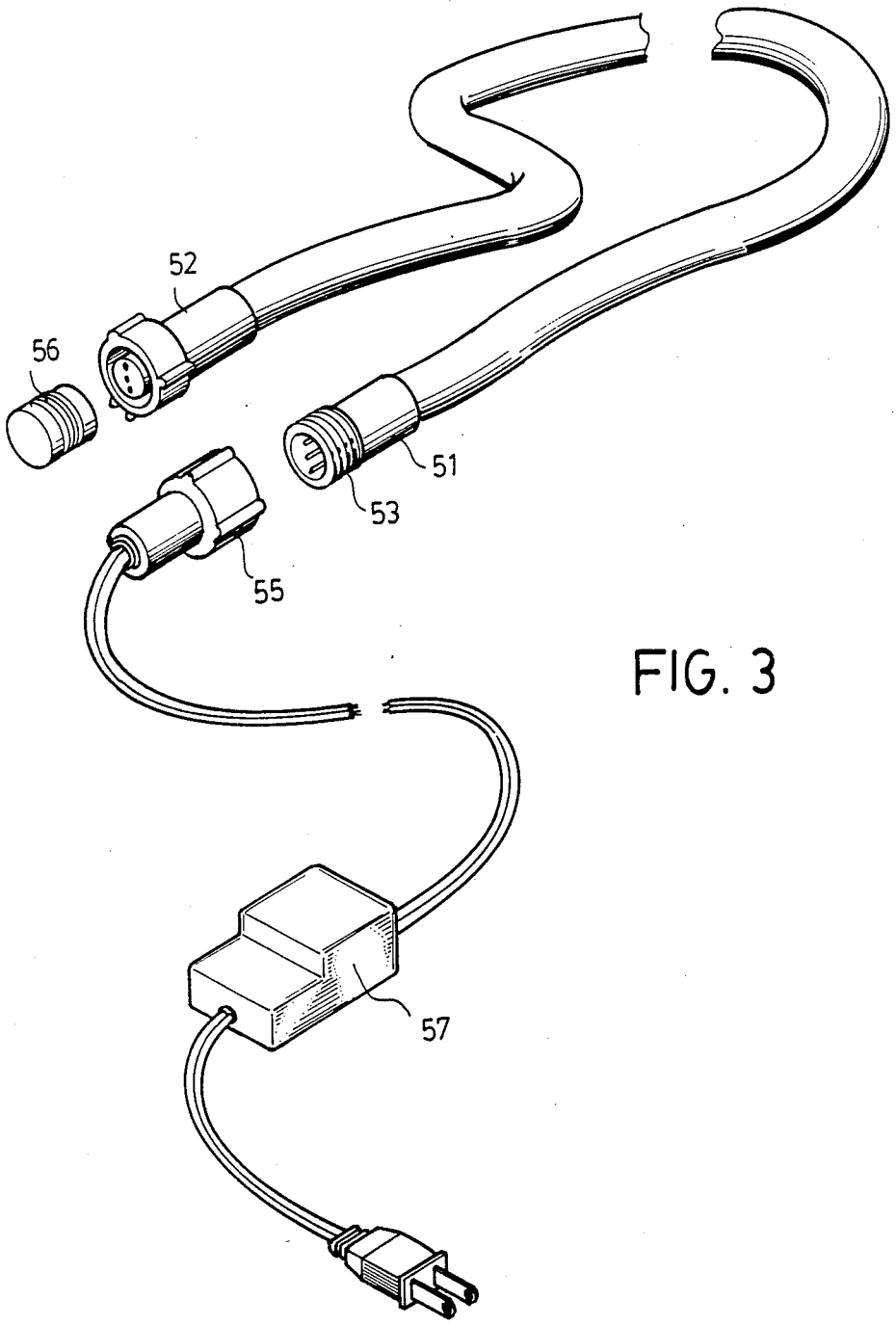
FIG. 3 is a perspective view showing the invention connecting to a controller.

Now referring to FIG. 3, it can be seen that each of the ends of the lamp-string device is mounted with a connector 51 (or 52). The connector 51 (male plug) has a threaded end 53 which is threadingly engaged with the sleeving end 55 of a flash-controlling unit 57. Another connector 52 (female socket) is coupled to a conducting contact 56 so as to form a complete closed circuit.

The flash-controlling unit 57 is substantially the same as the electrical selective switches which are already widely used in Christmas lamp-strings for controlling the bulb's flashing, therefore it is not necessary to describe the flash-controlling unit 57, per se, in detail herein.

Figure 4:
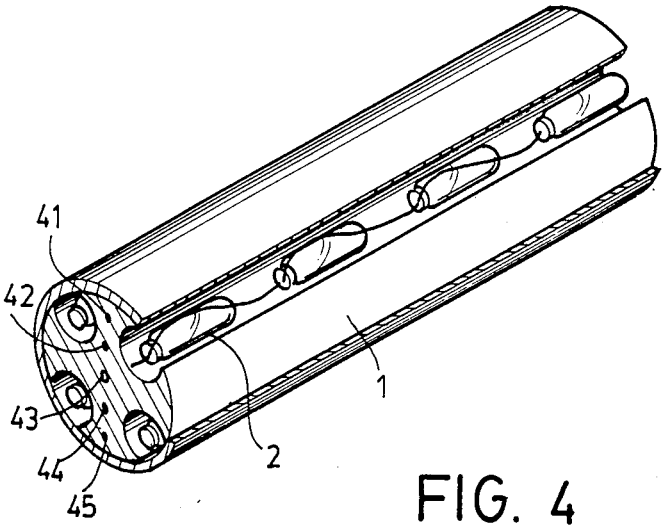
FIG. 4 shows a sectional view of an alternative embodiment of this invention with four lamp-strings.
Figure 5:
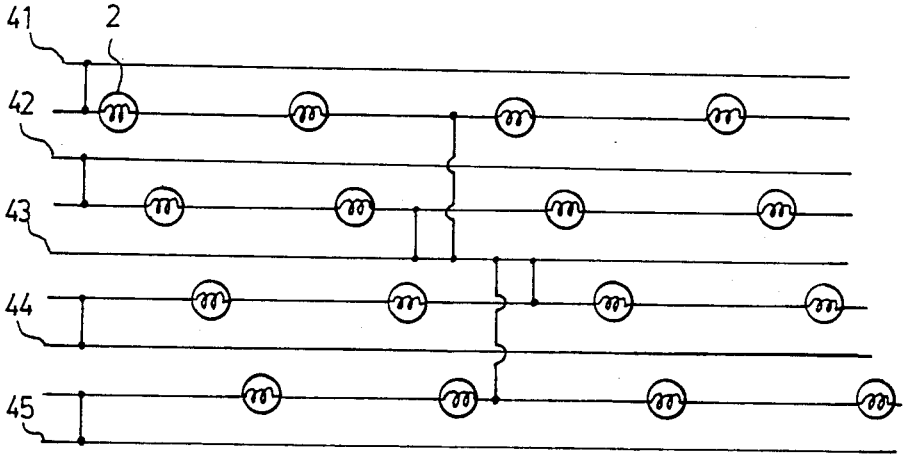
FIG. 5 is a circuit diagram showing the electrical connection of the embodiment of FIG. 4.

FIGS. 4 and 5 respectively show a sectional view and an accompanying circuit diagram of an embodiment with four lamp-string sets 2 of this invention. FIG. 4 shows five conducting wires wherein one 43 is a common wire and the others 41, 42, 44 and 45 are channel wires, respectively. Each of the lamp-string sets 2 has one end connected to a channel wire 41 or 42 or 44 or 45 and the other end connected to the common wire 43. More lamp-strings can be added according to the same technology of the invention as required.

The above examples and description have been given for purposes of illustration, and are not intended to be limitative. Many variations can be effected in the various compositions, methods and processes, without exceeding the scope of the invention.

I claim:

1. A flexible lamp-string device, comprising:

a mounting band made of transparent and pliable plastic material, and having an outer peripheral surface and at least one groove extending radially inwardly and axially along the mounting band;

at least one lamp-string set, each set comprising a plurality of lamp-strings installed in a respective groove of said mounting band;

conducting wires molded axially in said mounting band, one end of each of said lamp-strings being connected to a common wire of said conducting wires and another end of each said lamp-strings being connected to one of the other conducting wires; and a PVC tube having an inner surface and covering said mounting band, the at least one groove and an adjacent portion of the inner surface of the PVC tube forming an enclosure for receiving a lamp-string set therein, and providing means for waterproofing and shock-proofing said at least one lamp-string set.

2. A flexible lamp-string device according to claim 1, wherein the mounting band includes two grooves extending radially inwardly and axially along the mounting band, each groove receiving a lamp-string set therein.

3. A flexible lamp-string device according to claim 1, wherein the mounting band includes four grooves extending radially inwardly and axially along the mounting band, each groove receiving a lamp-string set therein.

4. A flexible lamp-string device according to claim 1, wherein each lamp-string includes a plurality of lamps, each lamp being fused for protecting the circuit upon breakage of a lamp.

5. A flexible lamp-string device, comprising:

a mounting band made of transparent and pliable plastic material, and having an outer peripheral surface and at least one groove extending radially inwardly and axially along the mounting band;

at least one lamp-string set, each set comprising a plurality of lamp-strings installed in a respective groove of said mounting band;

conducting wires molded axially in said mounting band, one end of each of said lamp-strings being connected to a common wire of said conducting wires and another end of each said lamp-strings being connected to one of the other conducting wires; and a PVC tube having an inner surface and covering said mounting band, and providing means for waterproofing and shock-proofing said at least one lamp-string set;

said conducting wires forming a wiring circuit; and a conducting contact connectable to the wiring circuit to form a complete closed circuit.

6. A flexible lamp-string device according to claim 5, wherein the mounting band includes two grooves extending radially inwardly and axially along the mounting band, each groove receiving a lamp-string set therein.

7. A flexible lamp-string device according to claim 5, wherein the mounting band includes four grooves extending radially inwardly and axially along the mounting band, each groove receiving a lamp-string set therein.

8. A flexible lamp-string device according to claim 5, wherein each lamp-string includes a plurality of lamps, each lamp being fused for protecting the circuit upon breakage of a lamp.

* * * * *